US007249785B2

(12) United States Patent
Resch et al.

(10) Patent No.: US 7,249,785 B2
(45) Date of Patent: Jul. 31, 2007

(54) BRAKE MECHANISM FOR A SKI

(75) Inventors: Franz Resch, Schladming (AT); Helmut Holzer, St. Johann (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 0 days.

(21) Appl. No.: 10/896,390

(22) Filed: Jul. 22, 2004

(65) Prior Publication Data

US 2005/0029759 A1 Feb. 10, 2005

(30) Foreign Application Priority Data

Aug. 6, 2003 (AT) ..... A 1234/2003

(51) Int. Cl.
*A63C 7/10* (2006.01)
*A63C 11/02* (2006.01)

(52) U.S. Cl. ..... 280/814; 280/605

(58) Field of Classification Search ..... 280/604, 280/605, 809, 814, 815
See application file for complete search history.

(56) References Cited

U.S. PATENT DOCUMENTS 4,108,466 A 8/1978 Weigl et al.
4,181,321 A 1/1980 Riedel
4,213,629 A 7/1980 Krob et al.
4,252,337 A * 2/1981 Luithlen ..... 280/605
4,266,804 A 5/1981 Murata
4,304,420 A * 12/1981 Krob et al. ..... 280/605
4,688,820 A * 8/1987 Spitaler et al. ..... 280/605
5,060,966 A * 10/1991 Sedlmair ..... 280/605
5,158,317 A * 10/1992 Sedlmair et al. ..... 280/605
5,630,608 A 5/1997 Luitz et al.

FOREIGN PATENT DOCUMENTS

AT 409 934 B 5/2002
DE 24 62 390 A1 * 12/1976
DE 28 01 614 A1 7/1979
DE 28 01 615 A1 7/1979
DE 28 27 182 A1 * 1/1980
EP 0 193 767 9/1986
EP 0 636 392 9/1996

* cited by examiner

*Primary Examiner*—Frank Vanaman
(74) *Attorney, Agent, or Firm*—Collard & Roe, P.C.

(57) ABSTRACT

A mechanism for braking a ski (1) released from a sports boot and for holding together skis (1) placed back to back with one another by their runner surfaces (2) if necessary. Catch elements (23, 24) are provided respectively on mutually facing inner sides and an oppositely lying outer sides of the brake arms (10) and a catch element (23) dispersed at least on the inner sides can be moved into a positive connection with at least one co-operating catch element (24) disposed on the outer sides in order to produce a higher resistance to counteract mutually crossing assembled brake arms (10) of two brake mechanisms (3) from sliding apart from one another.

16 Claims, 4 Drawing Sheets

BRAKE MECHANISM FOR A SKI

CROSS-REFERENCE TO RELATED APPLICATION

Priority is claimed under 35 USC 119 for Austrian application No. A 1243/2003, filed Aug. 6, 2003.

BACKGROUND OF THE INVENTION

1. Field of the Invention

The invention relates to a mechanism for braking a ski released from a sports boot and, if necessary, for holding together skis placed with their runner surfaces back to back against the other, incorporating a bearing mechanism for a brake lever assembly which can be attached to the top face of a ski, which brake lever assembly has brake levers disposed substantially symmetrically relative to the longitudinal mid-axis of the ski, each having operating arms and braking arms, which braking arms project out from the bearing mechanism and can be pivoted about at least one pivot axis by the force of stored energy from an operation-ready position above the runner surface of the ski into a braking position projecting out below the runner surface, and the operating arms extend from the bearing mechanism in a direction remote from the brake arms and are joined in displacement by means of a bearing arrangement with an impact plate which can be depressed by the sole of a sports boot, and a catch mechanism is provided on the braking arms to enable them to be releasably connected to mutually crossing brake arms of another brake mechanism of a co-operating, oppositely lying ski if necessary.

2. The Prior Art

EP 0 193 767 A1 discloses a ski brake with additional means for hooking two skis together if necessary. Accordingly, a recess or notch is provided on each of the inner faces in the region of the bottom free ends of the two brake arms. These notches are used for partially engaging the top and relatively thinner portion of the two brake arms of an oppositely lying ski, directed towards the bearing mechanism. When to connected one another, the two skis are therefore slightly offset from one another in the longitudinal direction.

U.S. Pat. No. 4,181,321 A discloses a ski brake, in which a notch is provided in the middle longitudinal portion of each of the inner faces of the two brake arms, which can be moved so as to engage with the outer edges or external boundary surfaces of the brake arms of an oppositely lying ski. Although two adjacently lying skis can be held together by this arrangement, a relative shifting of the two skis of a pair skis in the longitudinal direction can barely be prevented or can be so but not satisfactorily, as is the case with the embodiment mentioned above, which means that the brake connection can be inadvertently released, e.g. when carrying the pair of skis.

SUMMARY OF THE INVENTION

The underlying objective of the present invention is to improve a brake mechanism for skis so that two skis of a pair of skis can be reliably held together by means of the brake arms but the can be simply and easily activated and deactivated if necessary.

The invention achieves this objective by providing catch elements respectively on the mutually facing inner sides and on the oppositely lying outer sides of the brake arms, and at least one catch element disposed on the inner sides can be displaced into a positive connection with at least one co-operating catch element on the outer sides to permit a higher resistance to counteract mutually crossing joined brake arms from undesirably sliding apart from one another.

The advantage of this is that it provides a brake mechanism for skis which ensures good brake performance if a ski becomes detached during travel or if the user falls, on the one hand, and the brake mechanism also provides a convenient means of temporarily attaching or holding the skis of a pair of skis together. Consequently, two skis fitted with such brake mechanisms or so-called ski stoppers can be attached to one another without any tools at all and also without the aid of extra accessories such as straps, for example. Furthermore, skis attached to one another via the brake arms can be released from one another as and when necessary without any difficulty by applying sufficient separating force or effecting appropriate relative displacements. The mutual positive connection between two crossed over brake arms ensures a reliable connection between the skis of a pair of skis, which connection makes it much easier to carry and transport a pair of skis of this type. Another advantage is the fact that the user of sports equipment thus equipped is able to see immediately whether the brake arms have been correctly connected as desired. This can readily be checked by inspecting whether the catch elements have located with one another or not. This means that manual corrections can easily be made if necessary and the brake arms moved into their exact relative positions so that the pre-designed clamping force is obtained between the two skis. The visually perceptible catch elements also help the user of the sports equipment in terms of using the catch or coupling elements. In particular, the user will see unmistakably and virtually intuitively how the two skis of the pair of skis should be connected with a correspondingly high retaining force. It is also evident to the user how such a connection can be simply released. This is further assisted by manually applying separating forces to crossed-over brake arms. Another major advantage resides in the fact that it is irrelevant which brake lever pair is disposed on the outside or on the inside, which means that no special procedures or rules have to be followed when attaching two skis fitted with the brake mechanisms proposed by the invention. Quite simply, the skis merely have to be placed relative to one another in the longitudinal direction with their runner surfaces directed towards one another and lying adjacent, and then pushed until there is no longer any lengthways offset between skis. The respective oppositely lying brake arms of the two brake mechanisms of the pair of skis will therefore cross over one another and the crossed-over brake arms will mutually and preferably automatically be hooked by means of their catch elements.

In one embodiment of the mechanism, the intrinsic elasticity of the brake arms or at least one brake lever is selected so that a distance between the brake arms of a brake lever assembly can be varied and/or the brake lever assembly has degrees of freedom relative to the bearing mechanism, and the brake arms mutually cross with other brake arms and can be moved towards one another and/or moved apart from one another against resilient elastic forces, and/or the pivot axis of at least one brake arm is mounted so that the latter can slide axially against resilient elastic forces and/or its orientation can be varied, the advantage of which is that two complementary catch elements on the brake arms can be moved into positive engagement by a simple relative displacement between two corresponding brake mechanisms. Furthermore, when the catch elements are engaged by appropriate resilient elastic biassing forces between crossed-over brake arms, they are guaranteed to remain engaged, thereby preventing the brake arms from automatically and undesirably releasing.

Another embodiment of the mechanism which is of particular advantage is one in which the two brake arms of the brake lever assembly extend away from one another or diverge in the direction towards the free ends, starting from the bearing mechanism, because the fact of compensating the offset between two skis shifted from one another in the longitudinal direction ensures that the brake levers of one or both brake lever pairs are moved so as to lie on the inside and the other brake lever pair can slide with its brake arms along the external faces of the first brake lever pair, thereby securing a reliable, pre-defined cross-over of the four brake levers of two brake lever pairs.

Also of advantage is another embodiment of the mechanism, in which several catch elements, each of the same design, are provided in the longitudinal direction of the brake arms, because this enables the retaining force between attached skis and their brake mechanisms to be varied and adapted to the respective circumstances. Furthermore, with only a single design of brake mechanism, this brake mechanism can be used for various different types of skis, especially skis with different forward-biassing heights. In the case of skis with a relatively high forward-biassing height in particular, i.e. skis with a runner surface of a more pronounced longitudinal curvature, different catch elements can be activated than those of skis with a relatively shorter forward-biassing height, in other words skis of which the runner surfaces lie relatively close to one another in the binding mounting region.

A distance between successive elements as measured in the longitudinal direction of a brake arm is dimensioned so that complementary over-crossing brake arms can at least partially engage or locate in one another, thereby ensuring that the complementary catch elements move into a reliable engagement, ensuring a highly effective connection due to the mutual positive fit of the brake arms.

In another embodiment of the mechanism, at least one catch element lying adjacent to the catch element which lies in an engaged position with the catch element of an over-crossed brake arm sits substantially without any clearance against at least one boundary edge or external boundary surface of the crossing brake arm, thereby obtaining a multiple positive fit or a multiple mutual abutment of the brake arms, so that any twisting or other relative shifting between the brake arms can also be prevented. The fact that relative movements of the brake arms are comprehensively blocked means that the skis of a pair of skis are attached to one another particularly efficiently.

In one embodiment of the mechanism, at least one of differently designed, mutually co-operating catch elements on a flattened region of the inner and/or outer sides of the brake arms has a specifically designed shape, so that catch elements on the brake arms can be made a sufficiently large and their shape exactly designed, thereby resulting in a more effective positive fit with complementary catch elements.

Due to the fact that brake arms with an essentially rounded cross section have a slimmer thickness or a smaller diameter in the region of the flattened area than in the sections immediately adjacent to the flattened area, two complementary catch elements will snap into one another, even if they are in an only partially overlapping position with one another, and will then align virtually automatically. The catch elements between two over-crossed brake arms in effect make it easier to obtain an exactly overlapping position due to these recesses or indentations in the brake arms and due to the inclined regions or deflector edges.

As a result of the optional variant of the mechanism in which the catch elements are bounded by at least one step-shaped edge or inclined area by reference to the longitudinal direction of the brake arm, and/or the at least one step-shaped edge or step-shaped edges on either side of at least one catch element extend or run at an angle to the longitudinal axis of the brake arm, brake arms which are not positioned sufficiently exactly relative to one another are automatically aligned by these edges or deflector surfaces in such a way that the catch mechanism is able to engage reliably. In particular, even if a pair of skis is placed back to back without paying due attention, alignment of the brake arms is improved and assisted, thereby ensuring that the catch mechanism can be activated very efficiently.

In one embodiment of the mechanism, the catch elements are disposed within planes extending substantially perpendicular to the pivot axis and mutually engaging catch elements of an over-crossing attached pair of brake arms are designed so that increased mechanical resistance counteracts shifting in all directions along this plane, thereby securing a positive fit with sufficient retaining force and a good clamping and positive lock capable of preventing all shifting movements within a plane extending in the longitudinal direction of the skis and perpendicular to their runner surface.

In one embodiment of the mechanism, the catch elements are provided in the form of projection-type raised areas on the inner or outer side of a brake arm and the other catch elements co-operating with them are provided in the form of pot-shaped or pit-shaped recesses on the respective oppositely lying sides of each brake arm, which means that only partially overlapping catch elements can be automatically centred under some circumstances, thereby permitting a reliable mutual engagement or snap-fit.

In another embodiment of the mechanism, the matching catch elements are respectively provided in the form of ribs extending at an angle to the longitudinal extension of the brake arms, thereby permitting a strong locking action against shifting between two over-crossed brake arms and virtually preventing it altogether in a direction perpendicular thereto.

Because the brake arms have projections at their free ends which extend at an angle to their longitudinal extension, and/or the projections extend essentially perpendicular to the runner surface when the brake arms are in the braking position, and/or the projections extend in a pointed arrangement or conical shape starting from the region merging into the brake arms in the direction towards the free ends, the braking action of the brake mechanism on the respective ground underneath can be improved, in particular snow and ice.

BRIEF DESCRIPTION OF THE DRAWINGS

The invention will be described in more detail below with reference to examples of embodiments illustrated in the appended drawings. Of these.

DETAILED DESCRIPTION OF PREFERRED EMBODIMENTS

Figure 1:
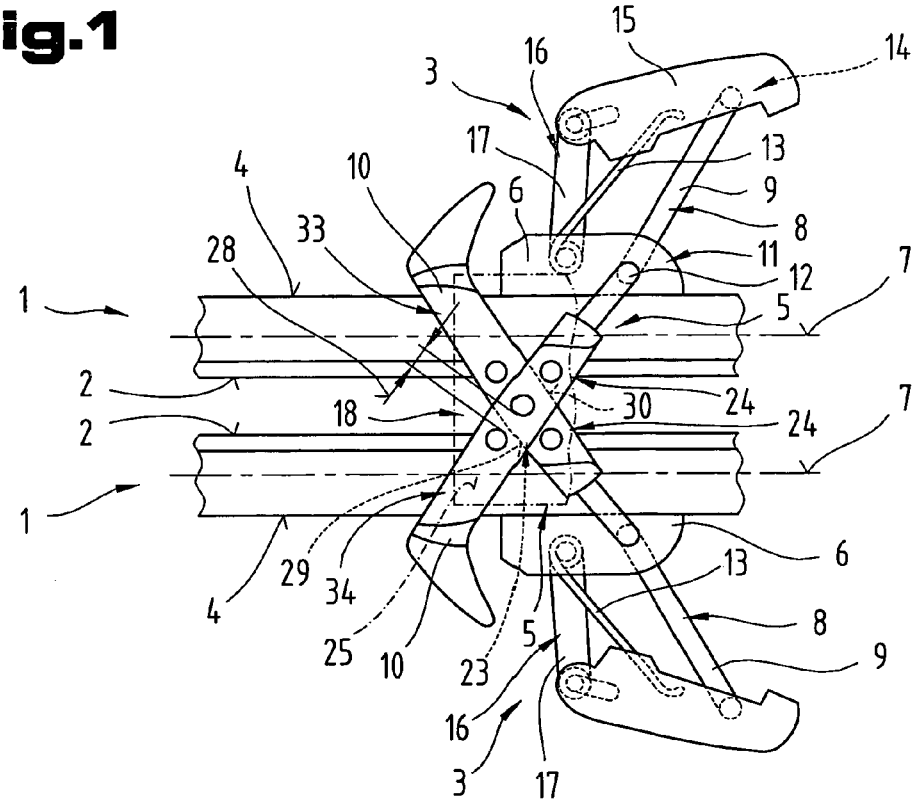
FIG. 1 is a simplified, schematic diagram showing a side view of an embodiment of two brake mechanisms proposed by the invention, holding together one section of a pair of skis.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc,. relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
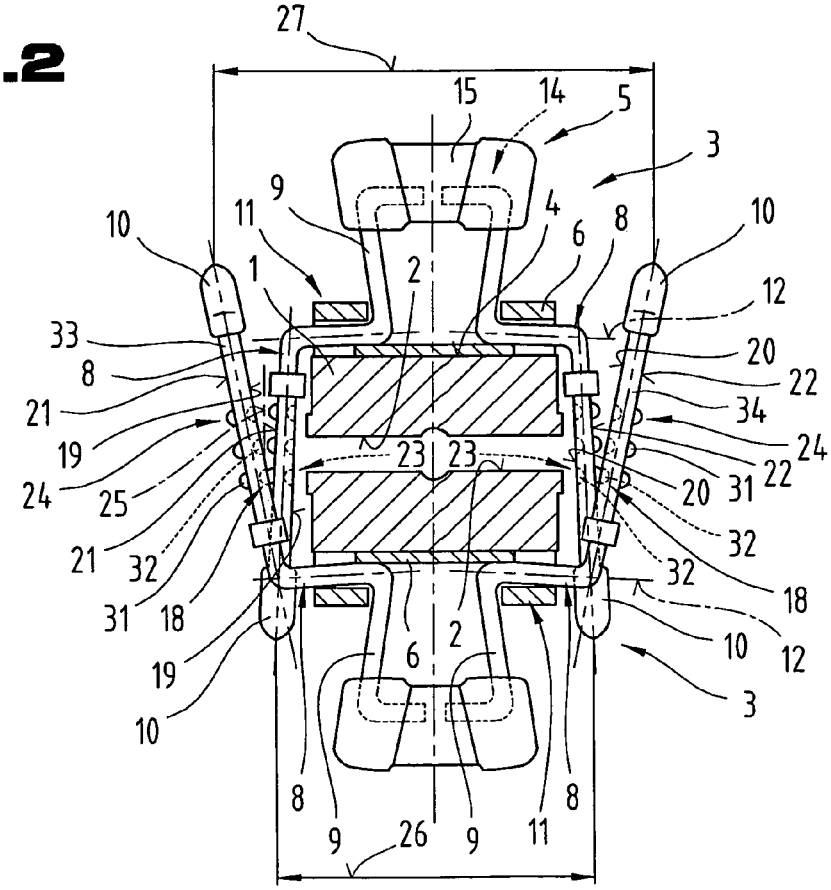
FIG. 2 is a highly simplified, partial diagram showing a cross section of the pair of skis illustrated in FIG. 1 with the brake mechanisms proposed by the invention.

FIGS. 1 and 2 illustrate a part-region of a pair of skis with the individual skis 1 placed back to back, with the runner surfaces 2 directed towards one another, and attached to one another by the respective designs of brake mechanisms 3 on the skis 1. A brake mechanism 3 of this type is usually disposed between the toe piece and heel piece of a ski binding and can be activated and deactivated by means of the sole of an appropriate sports boot. Accordingly, the brake mechanism 3 is disposed on a top face 4 of the skis 1 and preferably disposed in the area of the heel region of a sports boot. As long as the sports boot or its sole remain outside of the engagement region of the binding, the brake mechanism 3 is in the brake position in which a brake lever assembly 5 of the brake mechanism 3 stands proud of the runner surface 2 in certain sections.

The brake mechanism 3 also has a bearing mechanism 6, by means of which the brake lever assembly 5 is attached to the top face 4 of a ski 1.

This brake lever assembly 5 has two brake levers 8 disposed essentially symmetrically relative to a longitudinal mid-axis 7 of the ski 1. The two brake levers 8, which can be pivoted relative to the bearing mechanism 6 about a substantially horizontally extending axis, each have an operating arm 9 and a brake arm 10. An essentially right-angled offset, Z-shaped transition region between the brake arm 10 and the operating arm 9 of a brake lever 8, which transition region leads to a lateral offset between the longitudinal extensions of the operating arm 9 and the brake arm 10, forms a part of a pivot bearing 11 for the respective brake lever 8. This pivot bearing 11 has a pivot axis 12 extending essentially transversely to the longitudinal extension of the ski 1 and essentially parallel with its runner surface 2. The pivot axes 12 of both brake levers 8 of a brake mechanism 3 may be oriented slightly differently from one another, as may be seen in particular from FIG. 2.

The brake arms 10 can therefore be pivoted via this pivot bearing 11 by stored energy 13 from an operation-ready position disposed above the runner surface 2 of the ski 1 into a brake position projecting out below the runner surface 2 when the sports boot is released from the corresponding binding on the ski 1. When the sports boot is correctly inserted in the binding, parts of the brake mechanism 3, in particular its brake arms 10, are positioned above the plane of the runner surface 2 to guarantee an unhindered and unbraked sliding action of the ski 1 over the corresponding snow surface.

The stored energy 13 is preferably provided in the form of a spring, for example a torsion spring, which constantly forces the brake mechanism 3 into the brake position.

The brake arms 10 are moved from the brake position into the operation-ready position and vice versa via the operating arms 9, which extend in a direction remote from the brake arms 10 and project out beyond the pivot bearing 11.

The operating arms 9 of the two brake levers 8 are in turn linked in displacement, via a bearing arrangement 14, to an impact plate 15 which can be depressed by the sole of an appropriate sports boot. At the oppositely lying end portion, this impact plate 15 is additionally linked to the bearing mechanism 6 via another motion-transmitting element 16, such as a pivot lever 17 or a linearly slidable positioning element for example.

In any event, when the impact plate 15 is disposed in a distance from and substantially raised position relative to the bearing mechanism 6, the brake mechanism 3 is in the brake position, and is in the operation-ready position when the impact plate 15 is forced into position, for example by a boot applying pressure in the direction towards the ski 1 and in the direction towards the bearing mechanism 6. In this connection, it should be expressly pointed out that the kinematics between the impact plate 5 and the brake levers 8 and bearing mechanism 6 are not shown in the design illustrated in FIGS. 1 and 2 and in effect other brake mechanisms 3, such as those operating on the slider crank principle as disclosed in patent specification AT 409 934 B, may also be designed in the manner proposed by the invention.

The essential aspect is that the brake mechanism 3 has at least one catch mechanism 18 or mechanical connection means by means of which the skis 1 placed back to back by their runner surfaces 2 can be held together via the brake arms 10 of the two brake mechanisms 3 and separated from one another again, as and when necessary, without any complicated manoeuvres or the need for separate additional accessories such as connecting straps or similar.

To this end, at least one brake arm 10, preferably both brake arms 10, of the brake lever assembly 5, are provided with the catch mechanism 18 to provide a releasable connection, as and when necessary, with the brake arms 10 of a brake mechanism 3 of the same type. A coupling of this type can be used in particular if the brake arms 10 of the first brake mechanism 3 cross over the brake arms 10 of the other brake mechanism 3.

The essential point is that a brake lever assembly 5 is provided with catch elements 23, 24 on both the mutually facing inner sides 19, and on outer sides 21, 22 of the two brake arms lying opposite these inner sides 19, 20. The layout of the catch elements 23, 24 is selected in such a way that a catch element 23 or 24 on the inner side 19, 20 can be moved so as to connect in a positive fit with a complementary or matching catch elements 24 or 23 on the outer side 21, 22, so that a higher mechanical resistance counteracts any sliding apart of over-crossing assembled brake arms 10 of two brake mechanisms 3.

The complementary catch elements 23, 24 respectively provided on the inner and outer sides 19 to 22 are oriented substantially perpendicular to the runner surface 2 and disposed in a plane 25 pointing in the longitudinal direction of the ski 1. The shape of the catch elements 23, 24 is preferably selected so that when mutually engaging catch elements 23 and 24 of two brake mechanisms 3 of the same type are placed together, a higher mechanical resistance is obtained to counteract relative shifting in all directions within this plane 25. In other words, the co-operating catch elements 23, 24 on crossed-over brake arms 10 locate in one another in a positive fit in the manner of a "bolt-orifice connection", as may be seen more particularly from the diagram shown in FIG. 2. Accordingly, the plane 25 constitutes the dividing or joining plane between crossed-over brake arms 10 of a pair of brakes or skis. Relative displacements between two coupled skis 1 and brake mechanisms 3 in the direction perpendicular to the plane 25 are therefore restricted or prevented by the four crossed-over brake arms 10 of the two brake mechanisms 3 of a pair of skis, once the brake arms 10 of the first brake mechanism 3 are lying on the inside and the brake arms 10 of the other brake mechanism 3 are lying on the outside, and the outer brake arms 10 virtually engage round the brake arms 10 lying on the inside, as may best be seen from the diagram shown in section in FIG. 2.

In order to make it easier for this crossed arrangement of the same type of and identically sized brake lever assemblies 5 of two brake mechanisms 3 to be obtained, the two brake arms 10 of the brake lever assembly 5 extend slightly away from one another in the direction of the free ends, starting from the bearing mechanism 6, and the brake arms 10 diverge from one another in the direction of the free ends starting from the bearing mechanism 6. The distance between two brake arms 10 in the vicinity of the bearing mechanism 6 is therefore slightly shorter than the distance between these brake arms 10 in an end portion farther away from the bearing mechanism 6.

An improved connection and better stability of the brake arm coupling can be obtained due to the fact that the intrinsic elasticity of the brake arms 10 or at least one brake lever 8 of the brake lever assembly 5 is so selected that a distance 26 and 27 between the brake arms 10 of a crossed-over brake lever pair is variable. In other words, a distance 26, respectively 27, between the brake arms 10 of at least one brake mechanism 3 measured transversely to the ski longitudinal direction may be made shorter or longer. A distance 27 between the brake arms 10 in the initial state is preferably reduced to a slightly shorter distance 26 when two brake mechanisms 3 are placed together, as may be seen from the top brake mechanism 3 illustrated in FIG. 2.

The variable spacing of the brake arms 10 relative to one another can be achieved either as a result of the intrinsic elasticity of the brake arms 10 or due to the fact that the bearing mechanism 6 for the brake lever assembly 5 enables the distance 27 between the brake arms 10 of a brake lever assembly 5 to be made longer or shorter, preferably shorter.

Alternatively or in combination with this, however, it would also be possible to use a mounting whereby at least one pivot axis 12 for the brake lever 8 is able to slide or its disposition or orientation relative to the bearing mechanism 6 altered against a pre-defined force. This enables the crossed arrangement of two brake arms 10 necessary to place the brake arms 10 of two folded together brake mechanisms 3 to be obtained. In particular—as may best be seen by comparing the top and bottom brake mechanisms 3—the bearing mechanism 6 for the brake lever assembly 5 may be designed so that the pivot axis 12 of at least one brake lever 8 can be moved or adjusted against resiliently elastic, flexible forward biassing into its angular position relative to the top face 4 of the ski 1, starting from a relatively long distance 27 between the brake arms 10, to assume a position in which the distance 26 is slightly shorter. By preference, therefore, the bearing mechanism 6 is designed so that at least one pivot axis 12 but preferably both pivot axes 12 can be radially and/or axially adjusted relative to the bearing mechanism 6 against an elastic forward biassing to a sufficient degree. This elastic forward biassing, which can be accomplished by separate spring means or by the intrinsic elasticity of the brake levers 8, preferably forces the brake arms 10 apart, thereby resulting in the slightly longer distance 27 in the inactive position.

As may be seen most clearly from FIG. 2, the longitudinal mid-axes of the brake arms 10, starting from the bearing mechanism 6 and running in the direction to the ends spaced apart from the bearing mechanism 6, extend away from one another in an approximately conical arrangement. As a result of this more or less V-shaped contour of the two brake arms 10 of each brake lever assembly 5 as viewed from above, when two skis 1 placed back to back with one another by the runner surfaces, the two brake arms 10 of the first brake mechanism 3 are moved so that they lie more or less inside and the two brake arms 5 of the other brake mechanism 3 to lie outside, i.e. in abutment with the outer sides 21, 22 of the inwardly lying brake arms 10, as may be seen from FIG. 2.

In such a position, with the brake arms 10 of the first brake mechanism 3 lying virtually inside and the brake arms 10 of the other brake mechanism 3 lying virtually outside, the catch mechanism 18 between at least two crossed-over brake arms 10 is active, i.e. in a state as illustrated in FIGS. 1 and 2, at least two complementary catch elements 23, 24 engage with one another. In this engaged position with at least two brake arms 10 lying in a crossed-over arrangement, a snap-fit connection or clamp connection between two skis 1 is obtained via the two brake mechanisms 3. This catch mechanism 18 and the appropriately designed snap-fit connection between the four pairs of crossed-over brake arms 10 of two brake mechanisms 3 thereby exerts a defined retaining force, which prevents the two skis 1 from undesirably releasing or coming apart from one another. This snap-fit connection can not be automatically released unless a sufficiently high separating force or pushing motion is applied between the two skis 1 and the two brake mechanisms 3, causing the complementary catch elements 23, 24 to be moved out of engagement and thus releasing the attachment of the two skis 1.

As may also be seen from the embodiments illustrated, several catch elements 23, 24 are provided along the longitudinal extension of each of the brake arms 10. By preference, several mutually spaced catch elements 23, 24 are provided in the longitudinal direction on both the inner sides 19, 20 of the brake arms 10 and on the outer sides 21, 22 of the brake arms 10. In other words, this plurality of mutually spaced catch elements 23, 24 enables a plurality of connection positions or connection points to be obtained between the crossed-over brake arms 10.

As may also be seen from the diagrams, a distance 28 between the catch elements 23, respectively 24, as measured in the longitudinal direction of the brake arms 10 is selected so that complementary catch elements 23 and 24 on two crossed-over brake arms 10 are able to locate or engage at least partially in one another in order to activate the positive connection or catch mechanism 18.

In one advantageous embodiment which can be seen more easily in FIG. 1, at least one catch element 23 or 24, which is adjacent to the catch element 23 or 24 which sits in an engaged position with the catch element 24 or 23 when the brake arms 10 are crossed over, lies against at least one boundary edge 29, 30 or an outer boundary surface of the crossed-over brake arm 10 substantially without any clearance. As a result of this multiple positive lock or these multiple abutment positions or support faces between two crossed-over brake arms 10, the retaining effect or strength of two attached brake mechanisms 3 and the respective skis 2 can be enhanced still further. In particular, the mutual support on these additional boundary edges 29, 30 and the largely clearance-free abutment on the additional outer abutment and stop surfaces helps to prevent any twisting or relative shifting between the crossed-over brake arms 10, thereby counteracting any undesirable relative displacement or shifting between the two skis 1 of a pair of skis, e.g. when carrying the pair of skis.

In the preferred embodiments illustrated in FIGS. 1 and 2, the catch elements 23, 24 which can be brought into mutual engagement consist of projection-type raised areas 31 on the one hand and largely matching pot-shaped or pit-shaped recesses 32 on the other. It has been found to be of particular advantage if the raised areas 31 are spherical in shape and the recesses 32 are provided as pits with a complementary rounded or elliptical cross section. As an alternative to the multiple arrangement of raised areas 31 and recesses 32 on a brake arm 10 illustrated in FIGS. 1 and 2, it would naturally also be possible to provide only one recess 32 on each of the outer sides 21, 22 of the brake arms 10 and only one co-operating recess 31 on each of the inner sides 19, 20. In the embodiment illustrated, several recesses 32 are provided on the inner sides 19, 20 of each of the brake arms 10 whilst the outer sides 21, 22 of the brake arms 10 of each brake lever assembly 5 have several raised areas 31 which can be engaged with these recesses 32. Naturally, it would also be possible to opt for the reverse arrangement of raised areas 31 and recesses 32.

The end portions of the brake arms 10 remote from the bearing mechanism 6 are preferably provided with a casing 33, 34 of plastic material. The brake levers 8 themselves are preferably made in the form of an integral bar or wire of metal which is bent at several points, for example spring steel. This being the case, the end portions of these metal brake levers 8 remote from the bearing mechanism 6 are preferably encased in a plastic material by an injection moulding process in order to provide the relatively thin, metal wire brake arms 10 with wide brake paddles so that the end sections will improve braking action. As a result, the respective plastic casings 33, 34 are attached to the metal brake levers 8 in such a way that they can not be detached.

Figure 3:
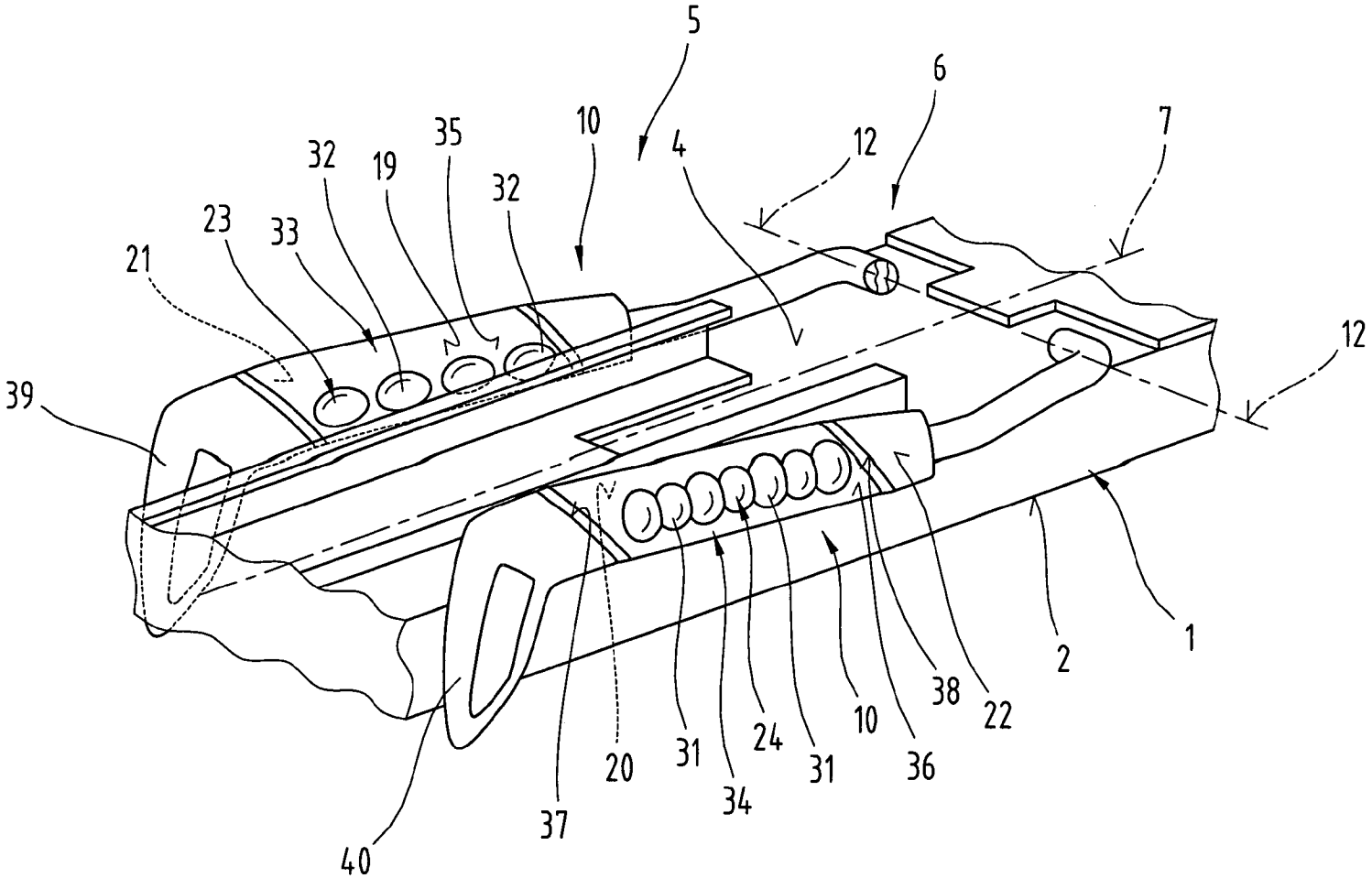
FIG. 3 shows a highly simplified, perspective view of a ski with a brake lever assembly of the design proposed by the invention.
Figure 4:
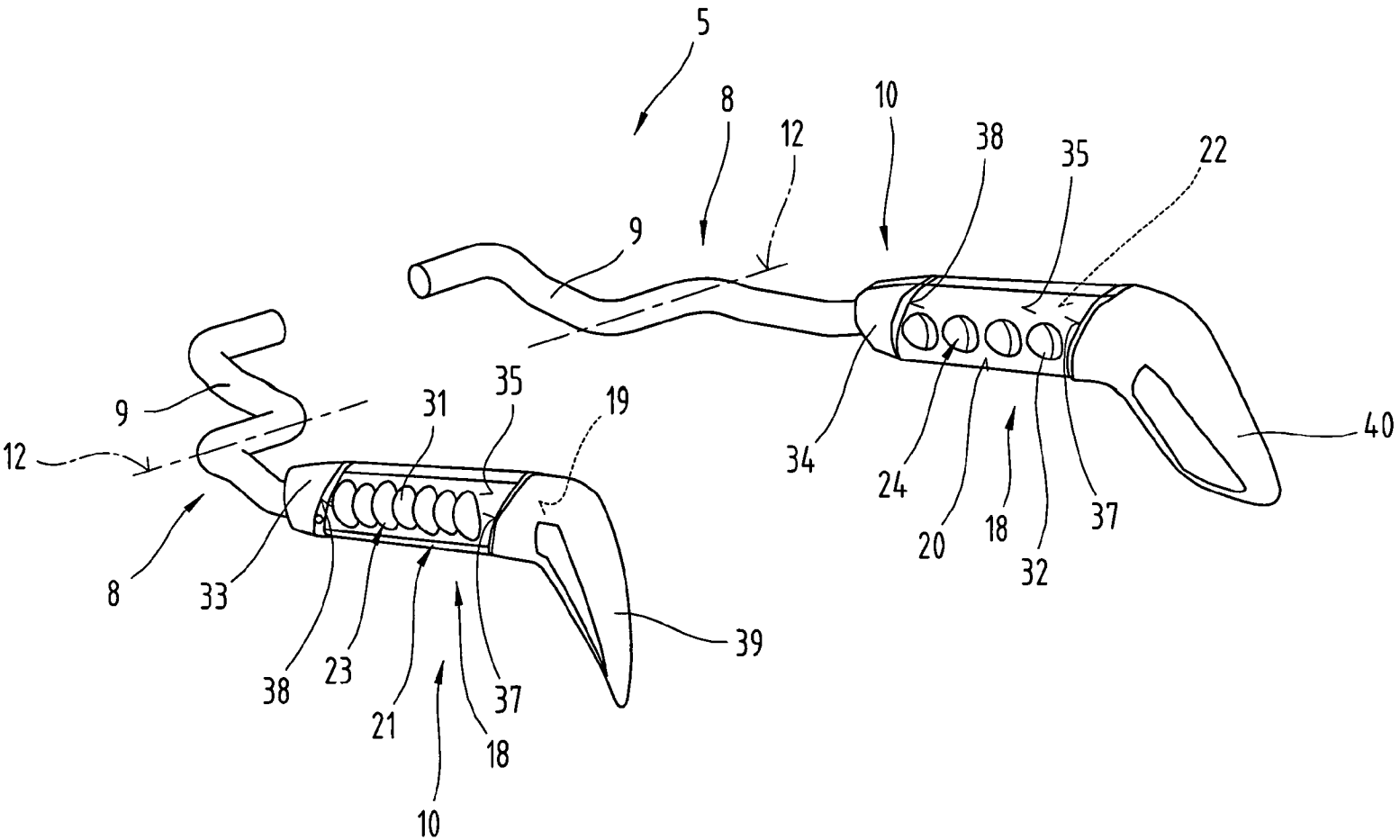
FIG. 4 is a perspective view from above, showing the brake lever assembly illustrated in FIG. 3.

FIGS. 3 and 4 illustrate a slightly different embodiment of the brake arms 10. In this case, the projection-type raised areas 31 on the outer sides 21 and. 22 of the brake arms 10 are preferably spaced closer to one another than the at least substantially complementary recesses 32 on the inner sides 19, 20. These raised areas 31 and recesses 32 can be moulded in the casings 33, 34 of the brake arms 10 in a perfectly simple manner.

The distances between the individual raised areas 31, respectively recesses 32, and their dimensions are selected so that a at least one raised area 31 can be located in at least one recess 32 sufficiently easily when two brake arms 10 are disposed in the crossed-over position. A lengthways and widthways dimension or diameter of the raised areas 31 and recesses 32 is 1 to 5 mm, preferably approximately 3 mm, and their height or depth is 1 to 4 mm, preferably approximately 2 mm.

As may best be seen from FIGS. 3 and 4, the catch elements 23, 24 may be provided on inner and/or outer flattened areas 35, 36 of the side face regions of the brake arms 10 and casings 33, 34. As a result of these flattened areas 35, 36 or pinched regions of the brake arms 5 in the sections incorporating the respective catch elements 23, 24, the catch elements 24 provided in the form of raised areas 31 in particular are arranged set back from the sections of the casing 33, respectively 34, adjoining the flattened areas 35 and 36. In other words, these flattened areas 35, 36 of the side parts or side regions of the brake arms 10 enable the raised areas 31 to be virtually recessed or set back from the adjoining sections in the longitudinal direction of the brake arms 10.

By preference, only one type or design of the differently designed 23, 24 is disposed on the inner sides 19, 20 of a brake arm pair and the other complementary design of the catch elements 23, 24 is provided only on the outer sides 21, 22 of this brake lever pair. In the embodiment illustrated as an example here, the recesses 32 are provided on the inwardly lying flattened areas 35 of the brake arm pair and the essentially complementary raised areas 31 are provided on the outer flattened areas 36 of the brake arm pair.

In the region of the at least one flattened area 35, 36, the brake arms 10 are slightly less thick and have a smaller diameter than in the sections immediately adjacent to the flattened areas 35, 36.

This being the case, the catch elements 23, 24 may be bounded by at least one edge 37, 38 which is step-shaped with respect to the longitudinal direction of the brake arms 10. As may best be seen from FIG. 3, the step-type edges 37, 38 or oblique surfaces, which are preferably provided on both end sections of the flattened areas 35, 36, also extend at an angle relative to the longitudinal axis of the brake arms 10.

As may also be seen from FIGS. 3 and 4, the brake arms 10 may also have extensions 37, 38 at their free ends, i.e. at their ends remote from the bearing mechanism 6 and pivot axis 12, extending at an angle relative to their longitudinal extension. These extensions 37, 38 run downwards, essentially perpendicular to the pivot axes 12 of the brake arms 10. The angle of the extensions 39, 40 at the ends of the brake arms 10 and casings 33, 34 is selected so that the extensions 39, 40 run essentially perpendicular to the runner surface 2 of a ski when the brake arms 10 are in the braking position.

In one advantageous embodiment, these extensions 39, 40 run towards one another in a pointed arrangement, stating from the section merging into or joining with the brake arms 10, in the direction towards the free ends or have a pointed end.

Figure 5:
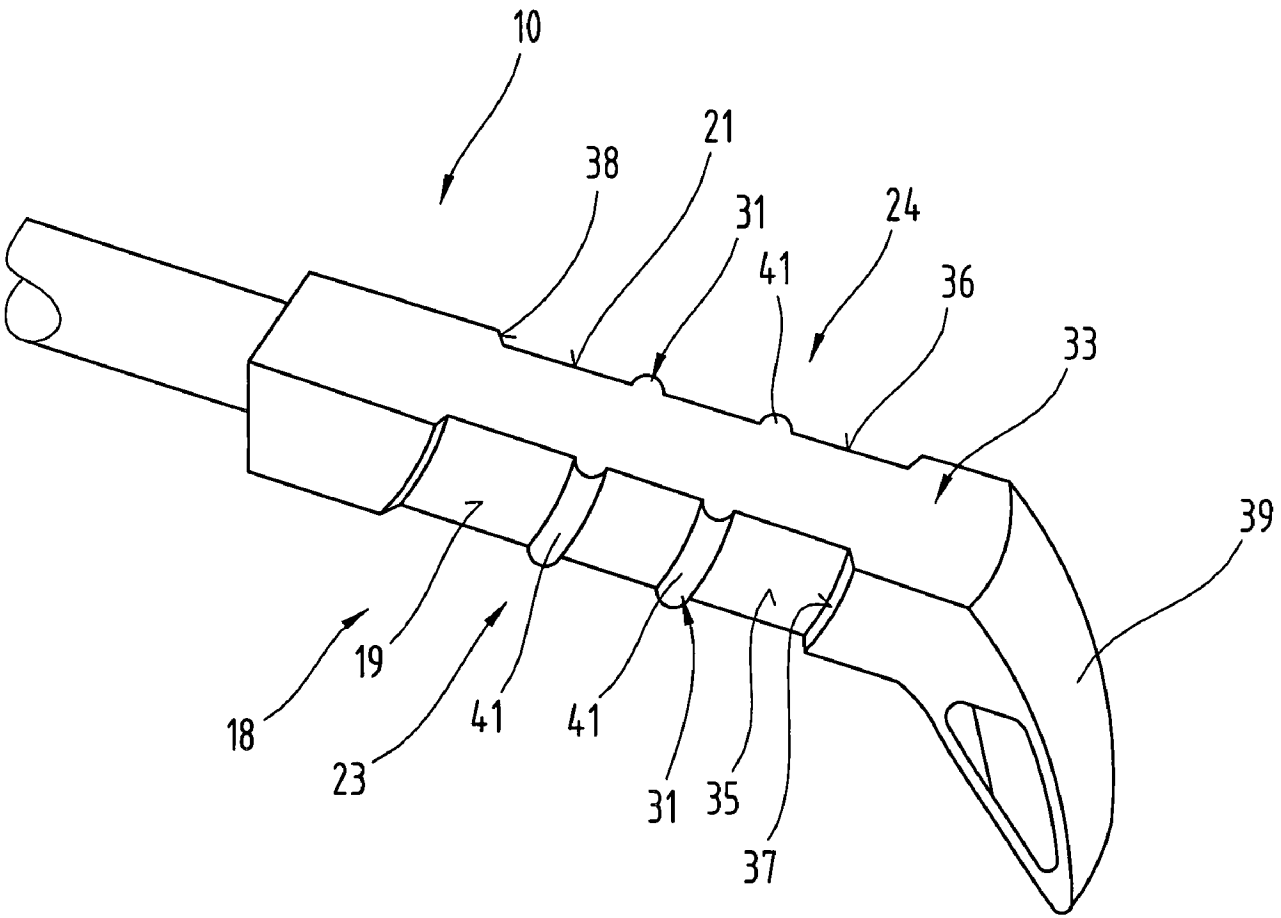
FIG. 5 shows another embodiment of a brake arm with a plurality of rib-type catch elements.

FIG. 5 illustrates a different embodiment of a brake arm 10 intended to provide a better retaining hold for two brake mechanisms fitted with such brake arms 10. In this case, the catch elements 23, 24 are provided in the form of rib-type raised areas 31. These raised areas 31 are also disposed in recessed lateral flattened areas 35, 36 of the plastic casing 33 of the brake arm end. The section incorporating the catch elements 23, 24 and catch mechanism 18 is therefore set back from the surrounding sections of the brake arm 10. As may also be seen, the catch elements 23, 24 provided in the form of the raised areas 31 are provided in the form of free areas or reductions in the thickness of the casing 33 on either side of these catch elements 23, 24.

Accordingly, at least two ribs 41 are formed on the inner side 19 and on the outer side 21 of this brake arms 10, spaced at a distance apart from one another. These ribs 41 preferably extend at a slight angle to the longitudinal extension of the brake arms 10 in order to ensure an effective hooking or latching action with another brake arm 10 disposed in a cross-over arrangement.

For the sake of good order, it should finally be pointed out that in order to provide a clearer understanding of the structure of the brake mechanism 3, it and its constituent parts are illustrated to a certain extent out of proportion and/or on an enlarged scale and/or on a reduced scale.

The underlying objectives and independent solutions proposed by the invention may be found in the description.

Above all, the embodiments illustrated in FIGS. 1, 2; 3, 4; 5 may be construed as independent solutions proposed by the invention in their own right. The underlying objectives and associated solutions may be found in the detailed description of these drawings.

LIST OF REFERENCE NUMBERS

1 Ski
2 Runner surface
3 Brake mechanism
4 Top face
5 Brake lever assembly
6 Bearing mechanism
7 Longitudinal mid-axis
8 Brake lever
9 Operating arm
10 Brake arm
11 Pivot bearing
12 Pivot axis
13 Stored energy
14 Bearing arrangement
15 Impact plate
16 Motion-transmitting element
17 Pivot lever
18 Catch mechanism
19 Inner side
20 Inner side
21 Outer side
22 Outer side
23 Catch element
24 Catch element
25 Plane
26 Distance
27 Distance
28 Distance
29 Boundary edge
30 Boundary edge
31 Raised area
32 Recess
33 Casing
34 Casing
35 Flattened area
36 Flattened area
37 Edge
38 Edge
39 Extension
40 Extension
41 Rib

What is claimed is:

1. A mechanism for braking a ski released from a sports boot, the ski having a runner surface and a top face, and for alternatively holding together a pair of said skis with facing runner surfaces, which comprises a bearing arrangement for a brake lever assembly attached to the top face of each ski, each brake lever assembly comprising a brake lever disposed substantially symmetrically with respect to a longitudinal center axis of the ski, the brake levers comprising operating arms and brake arms, the brake arms projecting from the bearing arrangement and being pivotal about a pivot axis by a stored energy source from an operation-ready position above the runner surface into a braking position below the runner surface, the operating arms extending from the bearing arrangment in a direction remote from the brake arms and being connected to an impact plate which can be depressed by the sole of the sports boot for movement with the impact plate, and the brake arms of the brake lever assemblies of the skis of the pair of skis intersecting for holding the skis together and having a catch mechanism for releasable connection of the brake arms, the catch mechanism comprising rows of catch elements of the same shape in each row on facing inner sides and remote outer sides of the brake arms, the catch elements being longitudinally aligned along the brake arms, and at least one catch element on the inner sides is movable into positive connection with at least one cooperating catch element on the outer sides to produce resistance counteracting undesired sliding apart of the intersecting brake arms.

2. The mechanism of claim 1, wherein the brake lever assembly has freedom of movement on the bearing arrangement, and the intersecting brake arms are movable towards and/or apart from each other against resiliently elastic forces.

3. The mechanism of claim 1, wherein the pivot axis of at least one brake arm is axially displaceable and/or is variable in orientation relative to the bearing arrangement.

4. The mechanism of claim 1, wherein the brake arms of the brake lever assemblies have diverging free ends.

5. The mechanism of claim 1, wherein a distance between successive ones of the catch elements in the rows is so dimensioned that complementary catch elements of the intersecting brake arms engage each other at least partially.

6. The mechanism of claim 5, wherein at least one of the catch elements adjacent a catch element engaging a catch element of the intersecting brake arm abuts at least substantially without clearance a boundary edge of the intersecting brake arm.

7. The mechanism of claim 1, wherein complementary ones of the catch elements on the brake arms are formed on flat faces of the inner sides and outer sides of the brake arms.

8. The mechanism of claim 7, wherein the brake arms have a smaller diameter in the region of the flat faces than in adjacent regions.

9. The mechanism of claim 1, wherein the rows of catch elements are bounded by at least one transverse step-shaped edge or inclined surface of the brake arm.

10. The mechanism of claim 9, wherein the at least one transverse step-shaped edge or inclined surface extends obliquely to the longitudinal axis of the brake arm.

11. The mechanism of claim 1, wherein the catch elements are disposed within planes extending substantially perpendicularly to the pivot axis, and engaging ones of the catch elements of the intersecting brake arms are so shaped that any shifting in said planes encounters an increased mechanical resistance.

12. The mechanism of claim 1, wherein the catch elements on one of the brake arms are protections and the cooperating catch elements are pot-shaped.

13. The mechanism of claim 1, wherein the cooperating catch elements are ribs extending obliquely to the longitudinal axis of the brake arms.

14. The mechanism of claim 1, wherein the brake arms have free ends with brake extensions extending at an angle to the longitudinal axis of the brake arms.

15. The mechanism of claim 14, wherein the brake extensions extend substantially perpendicularly to the runner surface of the ski in a braking position of the brake arms.

16. The mechanism of claim 15, wherein the brake extensions have a pointed or conical shape.

* * * * *

UNITED STATES PATENT AND TRADEMARK OFFICE

CERTIFICATE OF CORRECTION

PATENT NO. : 7,249,785 B2
APPLICATION NO. : 10/896390
DATED : July 31, 2007
INVENTOR(S) : F. Resch et al.

It is certified that error appears in the above-identified patent and that said Letters Patent is hereby corrected as shown below:

In particular, on the Title page, column 1, item [30], please change the Claim of Priority of the Foreign Application Priority data to correctly read as follows:

-- Aug. 6, 2003 (AT) .....A1243/2003--.

Signed and Sealed this

Ninth Day of October, 2007

JON W. DUDAS
*Director of the United States Patent and Trademark Office*